US007204304B2

(12) United States Patent
Rogers et al.

(10) Patent No.: US 7,204,304 B2
(45) Date of Patent: Apr. 17, 2007

(54) REMOVABLE SURFACE PACK-OFF DEVICE FOR REVERSE CEMENTING APPLICATIONS

(75) Inventors: Henry E. Rogers, Duncan, OK (US); Earl D. Webb, Wilson, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 294 days.

(21) Appl. No.: 10/786,573

(22) Filed: Feb. 25, 2004

(65) Prior Publication Data

US 2005/0183857 A1 Aug. 25, 2005

(51) Int. Cl.
*E21B 33/05* (2006.01)

(52) U.S. Cl. ..... 166/90.1; 166/93.1; 166/177.4

(58) Field of Classification Search ..... 166/379, 166/90.1, 93.1
See application file for complete search history.

(56) References Cited

U.S. PATENT DOCUMENTS

| | | | | | |
|---|---|---|---|---|---|
| 858,321 | A | * | 6/1907 | Auchu | 166/93.1 |
| 1,582,238 | A | * | 4/1926 | Arbon | 166/90.1 |
| 1,627,945 | A | * | 5/1927 | Wigle | 166/84.1 |
| 1,629,749 | A | * | 5/1927 | Sweeney | 166/75.13 |
| 1,648,039 | A | * | 11/1927 | Archer | 285/123.1 |
| 1,935,027 | A | * | 11/1933 | Heggem | 166/89.1 |
| 2,010,135 | A | * | 8/1935 | Boynton | 417/142 |
| 2,522,444 | A | * | 9/1950 | Grable | 166/81.1 |
| 2,647,727 | A | | 8/1953 | Edwards | 255/28 |
| 2,675,082 | A | | 4/1954 | Hall | 166/22 |
| 2,799,476 | A | * | 7/1957 | Bielstein | 166/86.1 |
| 2,849,213 | A | | 8/1958 | Failing | 255/24 |
| 2,919,709 | A | | 1/1960 | Schwegman | 137/68 |
| 3,051,246 | A | | 8/1962 | Clark, Jr. et al. | 166/226 |

(Continued)

FOREIGN PATENT DOCUMENTS

EP 0 419 281 A2 3/1991

(Continued)

OTHER PUBLICATIONS

SPE 1111 paper entitled "Primary Cementing By Reverse Circulation Solves Critical Problem in the North Hassi-Messaoud Field, Algeria" by R. Marquaire et al., dated Feb. 1966.

(Continued)

*Primary Examiner*—Jennifer H. Gay
*Assistant Examiner*—Robert Fuller
(74) *Attorney, Agent, or Firm*—John W. Wustenberg; Baker Botts, L.L.P.

(57) ABSTRACT

A removable surface pack-off device adapted for use in reverse cementing applications is provided. The device includes a housing adapted to be mounted between the ends of an inner casing and an outer casing at or near the surface of a well and at least one fluid passage disposed within the housing, which is adapted to pass fluid, such as cement, from a location outside of the well into an annulus formed between the inner and outer casings. It also includes a first pressure-activated seal disposed between the inner casing and the housing and a second pressure-activated seal disposed between the outer casing and the housing. The device further includes an attachment assembly, which enables the device to be easily removed from the well.

29 Claims, 4 Drawing Sheets

U.S. PATENT DOCUMENTS

| | | | | |
|---|---|---|---|---|
| 3,277,962 | A | 10/1966 | Flickinger et al. | 166/15 |
| 3,334,924 | A * | 8/1967 | Todd | 285/18 |
| 3,393,740 | A * | 7/1968 | Seese et al. | 166/93.1 |
| 3,763,936 | A * | 10/1973 | Menage | 169/45 |
| 3,948,322 | A | 4/1976 | Baker | 166/289 |
| 3,948,588 | A | 4/1976 | Curington et al. | 417/405 |
| 3,951,208 | A | 4/1976 | Delano | 166/78 |
| 3,965,987 | A * | 6/1976 | Biffle | 166/379 |
| 4,105,069 | A | 8/1978 | Baker | 166/51 |
| 4,169,504 | A * | 10/1979 | Scott | 166/90.1 |
| 4,271,916 | A | 6/1981 | Williams | 175/215 |
| 4,305,461 | A * | 12/1981 | Meyer | 166/77.4 |
| 4,548,271 | A | 10/1985 | Keller | 166/291 |
| 5,012,865 | A * | 5/1991 | McLeod | 166/90.1 |
| 5,024,273 | A | 6/1991 | Coone et al. | 166/289 |
| 5,044,388 | A * | 9/1991 | Barton et al. | 137/15.08 |
| 5,101,896 | A * | 4/1992 | Thompson et al. | 166/90.1 |
| 5,273,112 | A | 12/1993 | Schultz | 166/374 |
| 5,297,634 | A | 3/1994 | Loughlin | 166/387 |
| 5,494,107 | A | 2/1996 | Bode | 166/285 |
| 5,507,345 | A | 4/1996 | Wehunt, Jr. et al. | 166/285 |
| 5,571,281 | A | 11/1996 | Allen | 366/2 |
| 5,641,021 | A | 6/1997 | Murray et al. | 166/291 |
| 5,647,434 | A | 7/1997 | Sullaway et al. | 166/242.8 |
| 5,803,168 | A | 9/1998 | Lormand et al. | 166/77.2 |
| 5,829,526 | A | 11/1998 | Rogers et al. | 166/291 |
| 5,890,538 | A | 4/1999 | Beirute et al. | 166/285 |
| 6,098,710 | A | 8/2000 | Rhein-Knudsen et al. | 166/285 |
| 6,244,342 | B1 | 6/2001 | Sullaway et al. | 166/285 |
| 6,311,775 | B1 | 11/2001 | Allamon et al. | 166/285 |
| 6,318,472 | B1 | 11/2001 | Rogers et al. | 166/382 |
| 6,467,546 | B2 | 10/2002 | Allamon et al. | 166/381 |
| 6,481,494 | B1 | 11/2002 | Dusterhoft et al. | 166/51 |
| 6,484,804 | B2 | 11/2002 | Allamon et al. | 166/291 |
| 6,540,022 | B2 | 4/2003 | Dusterhoft et al. | 166/278 |
| 6,622,798 | B1 | 9/2003 | Rogers et al. | 166/380 |
| 6,666,266 | B2 | 12/2003 | Starr et al. | 166/90.1 |
| 6,732,797 | B1 | 5/2004 | Watters et al. | 166/291 |
| 6,745,842 | B2 * | 6/2004 | Hughes et al. | 166/383 |
| 6,758,281 | B2 | 7/2004 | Sullaway et al. | 166/386 |
| 6,808,024 | B2 | 10/2004 | Schwendemann et al. | 166/387 |
| 6,810,958 | B2 | 11/2004 | Szarka et al. | 166/285 |
| 2003/0072208 | A1 | 4/2003 | Rondeau et al. | 366/16 |
| 2005/0183857 | A1 * | 8/2005 | Rogers et al. | 166/90.1 |

FOREIGN PATENT DOCUMENTS

| | | |
|---|---|---|
| GB | 2 327 442 A | 1/1999 |
| GB | 2 348 828 A | 10/2000 |
| RU | 2 086 752 | 8/1997 |
| SU | 571584 | 10/1977 |
| SU | 1 542 143 | 12/1984 |

OTHER PUBLICATIONS

Foreign communication from a related counterpart application dated Feb. 24, 2005.

SPE 25540 entitled "Evaluation of the Effects of Multiples In Seismic Data From the Gulf Using Vertical Seismic Profiles" by Andrew Fryer, dated 1993.

SPE 29470 entitled "Monitoring Circulatable Hole with Real-Time Correction: Case Histories" by James E. Griffith, dated 1995.

IADC/SPE 35081 entitled "Drill-Cutting Removal in a Horizontal Wellbore For Cementing" by Krishna M. Ravi, dated 1996.

SPE/IADC 79907 entitled "Advances in Tieback Cementing" by Douglas P. MacEachern et al., dated 2003.

IADC/SPE 87197 entitled "Reverse Circulation of Primary Cementing Jobs—Evaluation and Case History" by Jason Davies et al., dated 2004.

* cited by examiner

REMOVABLE SURFACE PACK-OFF DEVICE FOR REVERSE CEMENTING APPLICATIONS

FIELD OF THE INVENTION

The present invention relates generally to devices for cementing tubing or casing in downhole environments, and more particularly to a reverse circulation device, which easily attaches to tubing or casing and has improved sealing characteristics.

BACKGROUND OF THE INVENTION

During downhole cementing operations, fluid circulation is generally performed by pumping down the inside of the tubing or casing and then back up the annular space around the casing. This type of circulation has been used successfully for many years. However, it has several drawbacks. First, the pressures required to "lift" the cement up into the annular space around the casing can sometimes damage the formation. Furthermore, it takes a fair amount of time to deliver the fluid to the annular space around the casing in this fashion.

In an effort to decrease the pressures exerted on the formation and to reduce pump time requirements, a solution involving pumping the fluid down the annular space of the casing rather than down the casing itself has been proposed. This technique, known as reverse circulation, requires lower delivery pressures, because the cement does not have to be lifted up the annulus. Furthermore, the reverse circulation technique is less time consuming than the conventional method because the fluid is delivered down the annulus only, rather than down the inside of the casing and back up the annulus. Accordingly, the cement travels approximately half the distance with this technique.

There are a number of drawbacks of current reverse circulation methods and devices. Such methods require a wellhead or other conventional surface pack-off to be attached to the surface casing that is sealably attached to the casing being cemented in place via the reverse circulation technique. These structures are often permanent and expensive, thus increasing the cost of completing the well. Furthermore, current surface pack-off equipment requires a threaded or flanged connection be at the surface casing for attaching thereto. This again adds unnecessarily to the complexity of the system, and thus its cost.

SUMMARY OF THE INVENTION

The present invention is directed to a surface pack-off device, which attaches between surface pipe and casing that allows for reverse circulation down the annulus of the casing to be cemented without a need for threaded or flanged connections.

More specifically, the present invention is directed to a removable surface pack-off device, which comprises a housing adapted to be mounted between the ends of an inner casing and an outer casing at or near the surface of a well. The device further includes at least one fluid passage disposed within the housing, which is adapted to pass fluid from a location outside of the well into an annulus formed between the inner and outer casings. In one aspect, the surface pack-off device according to the present invention includes means for sealing the housing to an inner casing and an outer casing. In one embodiment, the sealing means includes a first pressure-activated seal disposed between the inner casing and the housing and a second pressure-activated seal disposed between the outer casing and the housing.

In another aspect, the surface pack-off device according to present invention includes means for removably attaching the housing to the inner and outer casings. In one exemplary embodiment, the removable attachment means includes an attachment assembly, which comprises a pair of retaining wings mounted to an outer surface of the housing, a clamp defined by a pair of flanges, which is adapted to be secured to an outer surface of the outer casing, and a pair of retention bolts, which are mounted to the pair of retaining wings at one end and the pair of flanges at the other. In another exemplary embodiment, the removable attachment means comprises a plurality of holes drilled into the outer casing, which are adapted to receive a corresponding plurality of bolts, which secure the housing to the outer casing. The surface pack-off device according to the present invention is easily removed from the surface pipe and casing so that once the cementing operation is completed it can be used for a cementing operation at another well location.

The features and advantages of the present invention will be readily apparent to those skilled in the art upon a reading of the description of the exemplary embodiments, which follows.

BRIEF DESCRIPTION OF THE DRAWINGS

A more complete understanding of the present disclosure and advantages thereof may be acquired by referring to the following description taken in conjunction with the accompanying drawings, which.

DETAILED DESCRIPTION OF THE INVENTION

Figure 1:
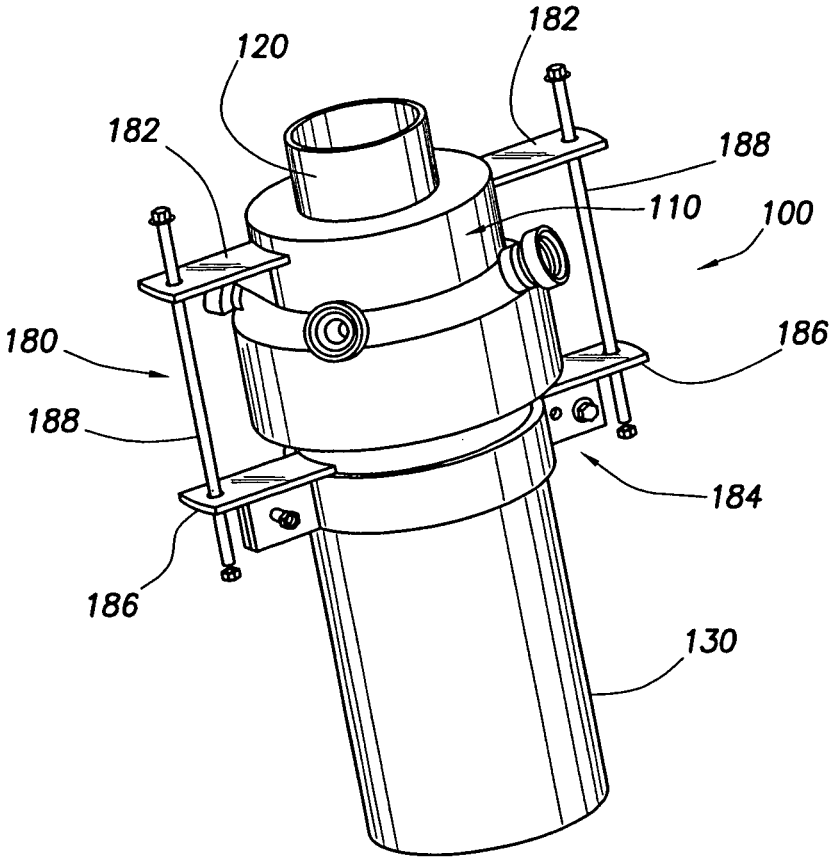
FIG. 1 is a perspective view of one embodiment of a surface pack-off device according to the present invention.
Figure 2:
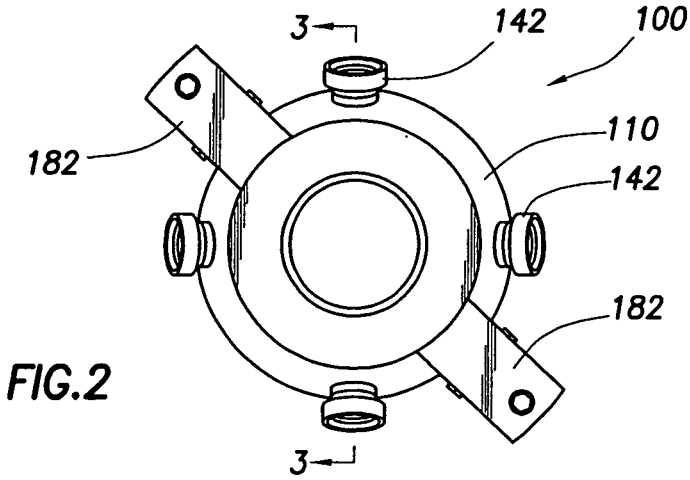
FIG. 2 is a top view of the surface pack-off device shown in FIG. 1.
Figure 3:
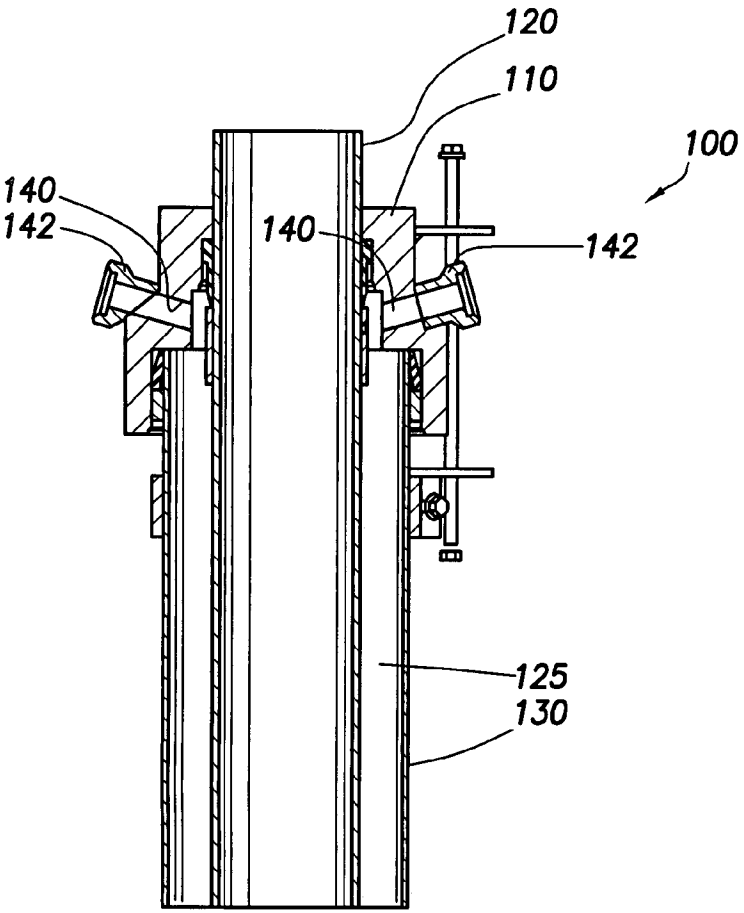
FIG. 3 is a cross-sectional view of the surface pack-off taken along line 3—3 shown in FIG. 2.

The details of the present invention will now be described with reference to the accompanying drawings. Turning to FIG. 1, a surface pack-off device in accordance with the present invention is shown generally by reference numeral 100. The surface pack-off device 100 includes a housing 110, which is generally cylindrical in shape. The housing 110 is designed to fit over and attach to an inner casing 120, which is the casing to be cemented, and an outer casing 130, which in one exemplary embodiment is a surface casing. An annulus 125 is formed between the inner casing 120 and outer casing 130, as shown in FIG. 3. Cement is pumped into the annulus 125 through the surface pack-off device 100 to secure the inner casing 120 to the outer casing 130.

The housing 110 has an upper portion, which in one exemplary embodiment seals against an outer surface of the inner casing 120, as shown in FIG. 3. The housing 110 in that same embodiment has a lower portion, which fits around an end of the outer casing 130 and seals against an outer surface of the outer casing 130, as also shown in FIG. 3. Both the inner and outer diameter of the lower portion of the housing 110 are greater than the inner and outer diameter of the upper portion of the housing. Housing 110 may be cast as one piece or two halves. In one certain embodiment, it is formed of ferrous metal typically used to make the casing pipes 120 and 130.

A plurality of fluid passages 140 are formed within the housing. The fluid passages 140 pass fluids, e.g., cement, from outside of the well into annulus 125. In one exemplary embodiment, four fluid passages 140 are provided. The four fluid passages are equally spaced around the circumference of the housing 110. Each fluid passage 140 has a corresponding inlet connector 142. The inlet connectors 142 couple the surface pack-off device 100 to a fluid supply line (not shown), so that fluid can be injected into annulus 125. In one exemplary embodiment, the inlet connectors 142 are a Model No. 1502 by WECO. As those of ordinary skill in the art will appreciate, the number and size of the fluid passages may be varied depending upon a number of factors, including, the amount of fluid needing to be delivered and the desired rate at which the fluid is to be delivered.

Figure 4:
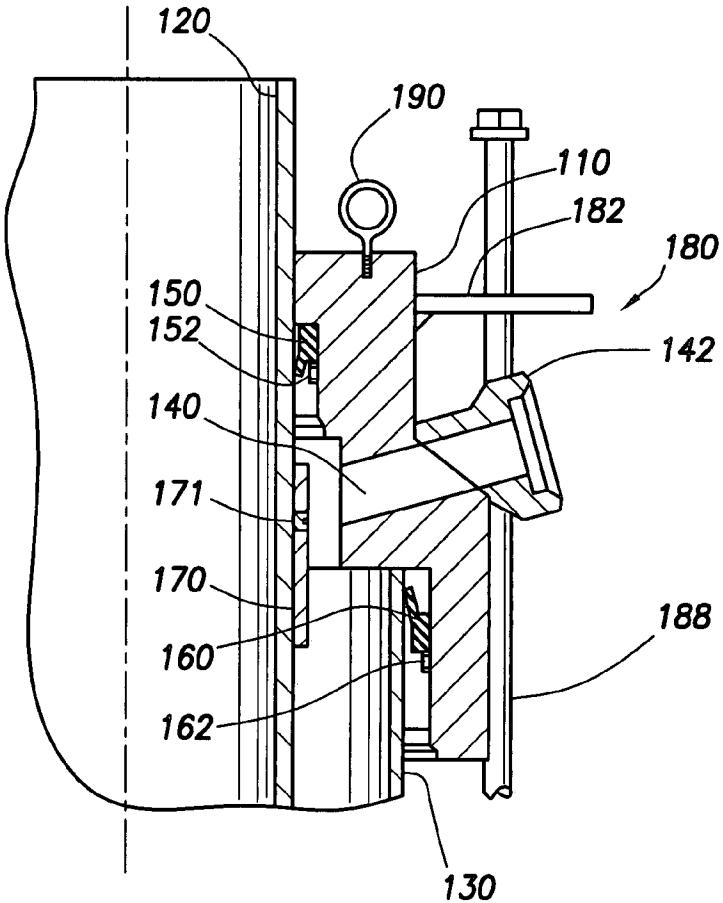
FIG. 4 is an enlarged view of the upper right-hand portion of the cross-sectional view of the surface pack-off shown in FIG. 3.

The surface pack-off device 100 further includes an energized cup-type or lip seal 150, which seals the housing 110 to the inner casing 120 when the fluid is injected into the annulus 125, as shown in FIG. 4. In one exemplary embodiment, the seal 150 is a pressure-activated seal. Furthermore, seal 150 is generally disk-shaped and may be formed of an elastomeric material. It has a tapered end, which engages a surface of the inner casing 120 in an interference fit when under pressure. The surface pack-off device further includes another energized cup-type or lip seal 160, which seals the housing 110 to the outer casing 130 when the fluid is injected into the annulus 125, as shown in FIG. 4. Like seal 150, seal 160 may be a pressure activated seal, is generally disk-shaped and may be formed of an elastomeric material. Furthermore, it has a tapered end, which engages a surface of outer casing 160 in an interference fit when under pressure. A pair of retaining nuts 152 and 162 hold the seals 150 and 160 in place against the housing 110.

The surface pack-off device 100 further includes a protective sleeve 170, which is designed to fit around the outer circumferential surface of the inner casing 120, as shown in FIG. 4. In one exemplary embodiment, the protective sleeve 170 is formed of a ferrous metal similar to that used in making the housing 110 and casings 120 and 130. The protective sleeve 170 protects the inner casing 120 from erosion caused by the high pressure fluid being injected into the annulus 125 through the fluid passages 140. The protective sleeve 170 is disposed opposite the exit ports of the fluid passages 140. In one embodiment, the protective sleeve is secured to the inner casing 120 by one or more set screws 171.

The surface pack-off device 100 further includes an attachment assembly 180, which is designed to removably attach the device to the surface ends of the inner and outer casings 120 and 130. In one embodiment, the attachment assembly 180 includes a pair of retaining wings 182 mounted to the outer cylindrical surface of the housing 110, as shown in FIG. 1. The retaining wings 182 may be integrally formed with the housing 110 or attached thereto using known securing techniques. The attachment assembly 180 also includes a clamp 184 defined by a pair of flanges or wings 186. The clamp 184 is formed by two halves of a split collar, which are held together by a pair of nuts and bolts or other similar equivalent securing means. The clamp 184 is designed to secure to the outer surface of the outer casing 130. As will be appreciated by those of ordinary skill in the art, the clamp 184 may be easily removed from the outer casing 130. The clamp 184 attaches to the retaining wings 182 of the housing 110 via a pair of retention bolts 188. As those of ordinary skill in the art will appreciate, any number of securing means may be used to secure the housing 110 to the clamp 184. An advantage of the attachment assembly 180 is that it enables the surface pack-off device 100 to be attached to casing assemblies that do not have threaded or flanged connections. Furthermore, the attachment assembly 180 enables the surface pack-off device 100 to be attached to an existing casing assembly without modification to the structure of the existing casing assembly.

Figure 5:
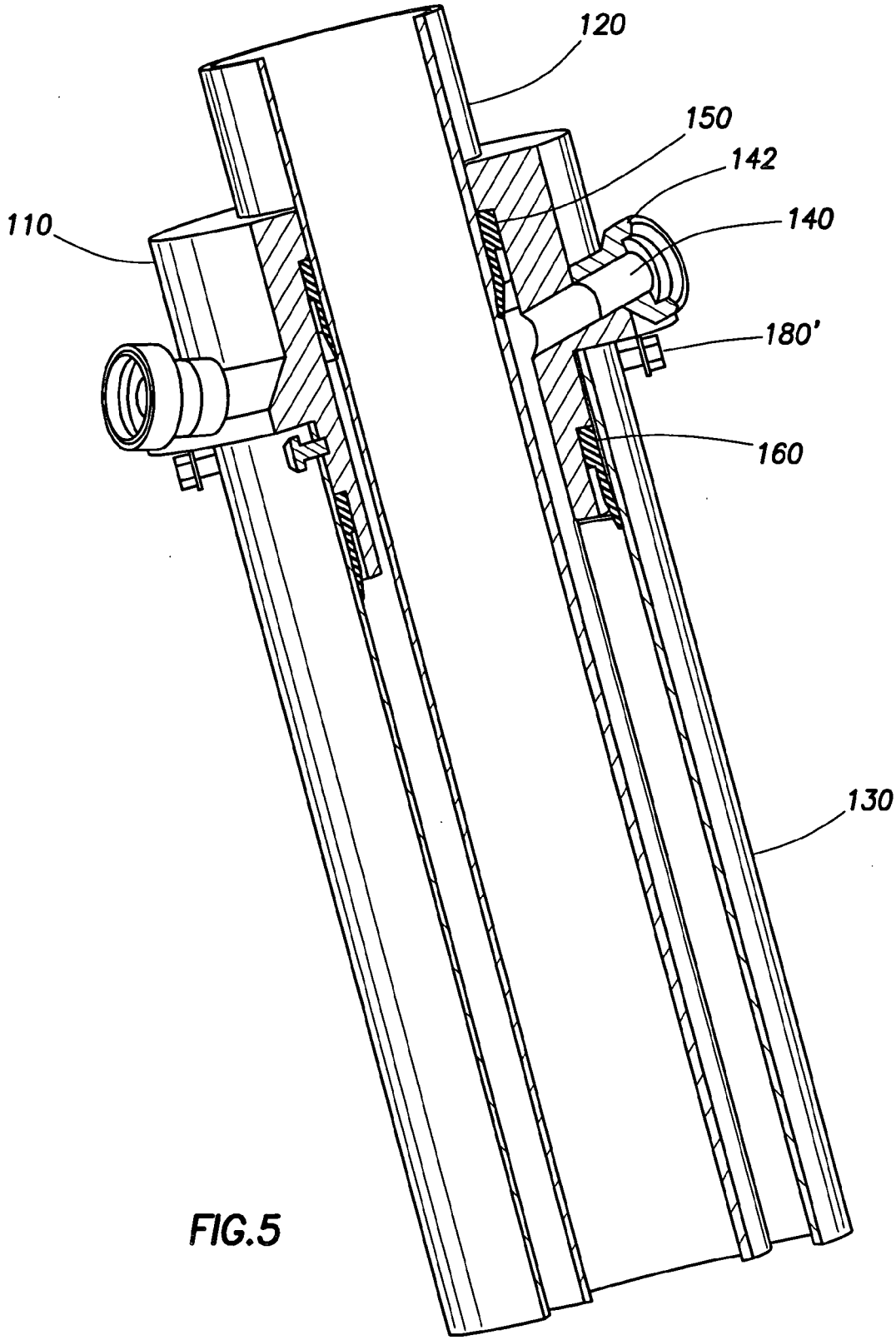
FIG. 5 is a partial cut-away perspective view of another embodiment of the surface pack-off device according to the present invention.
Figure 6:
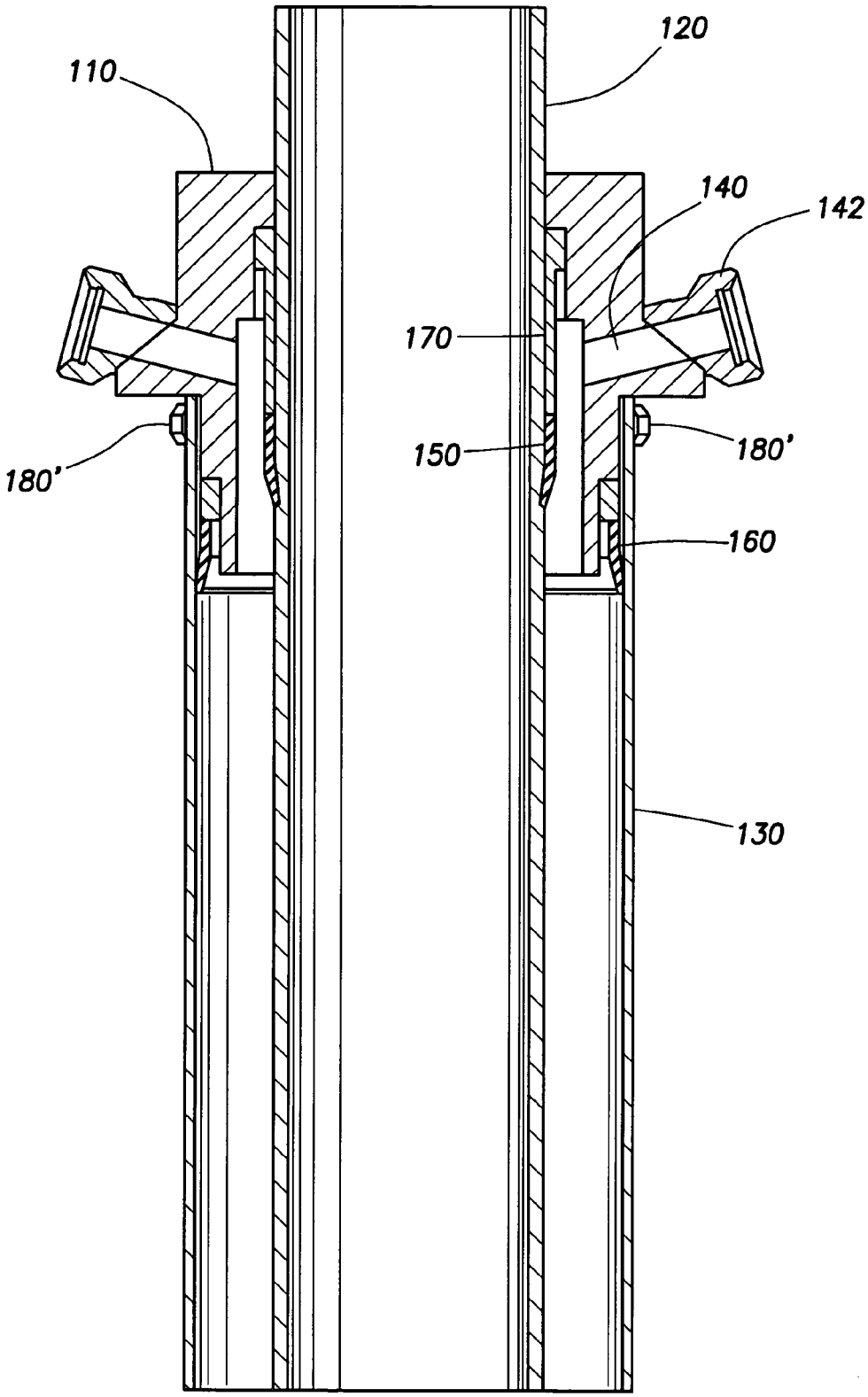
FIG. 6 is cross-sectional view of the surface pack-off device shown in FIG. 5 taken along the longitudinal direction.

An alternate embodiment of the attachment assembly 180' is shown in FIGS. 5 and 6. In this embodiment, the attachment assembly 180' essentially comprises a plurality of bolts, which are secured through holes formed in the outer casing 130 and clamp onto the outer surface of the housing 110. An advantage of attachment assembly 180' is its simplicity in design. Both attachment assemblies 180 and 180' have a significant advantage over prior art devices in that they allow for easy attachment to, and removal from, the surface of a well casing assembly.

The surface pack-off device 100 may also include one or more eye hooks 190 (one shown) attached to the top of the housing 110. The eye hook 190 is provided to enable well operators to easily lift the surface pack-off device 100 onto, or off of, the surface of the well casing assembly during installation and removal, respectively.

In the embodiment of the surface pack-off device 100 shown in FIGS. 1–4, the housing 110 is designed to seal against the outer surfaces of the inner and outer casings 120 and 130. This design is particularly well-suited for annuluses, which are small. For wider annuluses, an alternate design of the surface pack-off device 100 may be employed. In this alternate design, the lower cup seal 160 is disposed inside of the outer casing 130, i.e., between the outer surface of the lower portion of the housing 110 and the inner surface of the outer casing 130. This configuration of the surface pack-off device 100 is illustrated in FIGS. 5 and 6. This embodiment is more compact than the embodiment shown in FIGS. 1–4.

Therefore, the present invention is well-adapted to carry out the objects and attain the ends and advantages mentioned as well as those which are inherent therein. While the invention has been depicted, described, and is defined by reference to exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A removable surface pack-off device, comprising:

a housing adapted to be mounted between the ends of an inner casing and an outer casing at or near the surface of a well;

at least one fluid passage disposed within the housing, which is adapted to pass fluid from a location outside of the well into an annulus formed between the inner and outer casings;

a first pressure-activated seal disposed between the inner casing and the housing;

a second pressure-activated seal disposed between the outer casing and the housing; and wherein the first and second pressure-activated seals are each formed of an elastomeric disk each having a tapered end, which engages a surface of the respective casing in an interference fit when under pressure.

2. The removable surface pack-off device according to claim 1, further comprising a pair of retaining wings mounted to an outer surface of the housing.

3. The removable surface pack-off device according to claim 2, further comprising a clamp defined by a pair of flanges, which is adapted to be secured to an outer surface of the outer casing.

4. The removable surface pack-off device according to claim 3, wherein the clamp is formed in two halves, which are secured to one another around the outer surface of the outer casing by a pair of bolts.

5. The removable surface pack-off device according to claim 3, further comprising a pair of retention bolts, which are mounted to the pair of retaining wings at one end and the pair of flanges at the other.

6. The removable surface pack-off device according to claim 1, wherein a plurality of holes are drilled into the outer casing, which are adapted, to receive a corresponding plurality of bolts, which secure the housing to the outer casing.

7. The removable surface pack-off device according to claim 1, wherein the first pressure activated seal is disposed between an outer surface of the inner casing and an inner surface of the housing.

8. The removable surface pack-off device according to claim 1, wherein the second pressure activated seal is disposed between an outer surface of the outer casing and an inner surface of the housing.

9. The removable surface pack-off device according to claim 1, wherein the second pressure activated seal is disposed between an inner surface of the outer casing and an outer surface of the housing.

10. The removable surface pack-off device according to claim 1, wherein the first pressure activated seal is secured in place by a retaining nut mounted to the housing and the second pressure activated seal is secured in place by a retaining nut mounted to the housing.

11. The removable surface pack-off device according to claim 1, further comprising an inlet connector, which is attached to the housing and is adapted to couple to a fluid supply source.

12. The removable surface pack-off device according to claim 1, further comprising a protective sleeve disposed on the outer surface of the inner casing opposite the at least one fluid passage.

13. The removable surface pack-off device according to claim 1, further comprising an eye hook mounted to a top surface of the housing, which enables the surface pack-off device to be lifted onto and off of the casings.

14. A removable surface pack-off device, comprising:

a housing adapted to be mounted between the ends of an inner casing and an outer casing at or near the surface of a well;

at least one fluid passage disposed within the housing, which is adapted to pass fluid from a location outside of the well into an annulus formed between the inner and outer casings;

means for sealing the housing to an inner casing and an outer casing, and means for removably attaching the housing to the inner and outer casings, wherein the removable attachment means comprises a plurality of holes drilled into the outer casing, which are adapted to receive a corresponding plurality of bolts, which secure the housing to the outer casing.

15. The removable surface pack-off device according to claim 14, wherein the sealing means comprises a first pressure-activated seal disposed between the inner casing and the housing and a second pressure-activated seal disposed between the outer casing and the housing.

16. The removable surface pack-off device according to claim 15, wherein the first and second pressure-activated seals are cup-type seals.

17. The removable surface pack-off device according to claim 15, wherein the first and second pressure-activated seals are each formed of an elastomeric disk each having a tapered end, which engages a surface of the respective casing in an interference fit when under pressure.

18. The removable surface pack-off device according to claim 15, wherein the first pressure activated seal is disposed between an outer surface of the inner casing and an inner surface of the housing.

19. The removable surface pack-off device according to claim 15, wherein the second pressure activated seal is disposed between an outer surface of the outer casing and an inner surface of the housing.

20. The removable surface pack-off device according to claim 15, wherein the second pressure activated seal is disposed between an inner surface of the outer casing and an outer surface of the housing.

21. The removable surface pack-off device according to claim 15, wherein the first pressure activated seal is secured in place by a retaining nut mounted to the housing and the second pressure activated seal is secured in place by a retaining nut mounted to the housing.

22. The removable surface pack-off device according to claim 14, wherein the removable attachment means comprises a pair of retaining wings mounted to an outer surface of the housing.

23. The removable surface pack-off device according to claim 22, wherein the removable attachment means further comprises a clamp defined by a pair of flanges, which is adapted to be secured to an outer surface of the outer casing.

24. The removable surface pack-off device according to claim 23, wherein the clamp is formed in two halves, which are secured to one another around the outer surface of the outer casing by a pair of bolts.

25. The removable surface pack-off device according to claim 23, further comprising a pair of retention bolts, which are mounted to the pair of retaining wings at one end and the pair of flanges at the other.

26. The removable surface pack-off device according to claim 14, wherein the removable attachment means further comprises the corresponding plurality of mounting bolts.

27. The removable surface pack-off device according to claim 14, further comprising an inlet connector, which is attached to the housing and is adapted to couple to a fluid supply source.

28. The removable surface pack-off device according to claim 14, further comprising a protective sleeve disposed on the outer surface of the inner casing opposite the at least one fluid passage.

29. The removable surface pack-off device according to claim 14, further comprising an eye hook mounted to a top surface of the housing, which enables the surface pack-off device to be lifted onto and off of the casings.

* * * * *